United States Patent [19]

Casale

[11] Patent Number: 5,041,047

[45] Date of Patent: Aug. 20, 1991

[54] BALLOON WITH ADDITIONAL INTERIOR DISPLAY SURFACES

[76] Inventor: Angelo J. Casale, 74-02 Thirteenth Ave., Brooklyn, N.Y. 11228

[21] Appl. No.: 544,930

[22] Filed: Jun. 28, 1990

[51] Int. Cl.[5] ..... A63H 27/10

[52] U.S. Cl. ..... 446/220; 40/214

[58] Field of Search ..... 446/220, 226, 221; 244/31, 33; 40/412, 477, 212, 214, 610

[56] References Cited

U.S. PATENT DOCUMENTS 2,463,517 3/1949 Chromak ..... 446/220

4,232,477 11/1980 Lin ..... 446/220 X

*Primary Examiner*—Mickey Yu

*Attorney, Agent, or Firm*—Gary Cohen

[57] ABSTRACT

A balloon is disclosed, with additional interior display surfaces, useful in advertising and for novelties and toys and recreational equipment. The additional display surfaces are not curved like the outside of a balloon. A sheet of flexible material is adhesively connected at a plurality of points on its perimeter to the inside wall of the balloon, dividing the interior volume of the balloon into two chambers. The balloon and sheet may be substantially inelastic, such as a beach ball, or stretchable, such as a novelty latex balloon. In a preferred embodiment, the sheet is a porous, stretchable, floccose material which simulates having a spider web inside the balloon. This can be used as a Halloween decoration or inside fun houses or spook houses at amusement parks.

7 Claims, 1 Drawing Sheet

BALLOON WITH ADDITIONAL INTERIOR DISPLAY SURFACES

BACKGROUND OF THE INVENTION

The invention concerns balloons and inflatables, in general, and more particularly, balloons and inflatables with additional interior display surfaces.

Balloons and inflatables are well known, and have been for hundreds of years. They are useful as toys, novelties, sports equipment, among other utilities, in the field of recreation. They are used for meteorology, in particular when atmospheric weather conditions are being recorded and determined. They are useful in the advertising field, in sizes from simple latex balloons with a drawing or likeness or words printed on the outside, up to gigantic blimps and dirigibles, such as e.g. the famous "Goodyear Blimp". In addition, balloons and inflatables have been used for numerous medical purposes, in particular in the field of surgery, for example, to temporarily open up closed blood vessels.

It is a major problem with the use of balloon surfaces for advertising purposes that, inasmuch the outside surfaces are spherical or at least cylindrical, the curved surface distorts the advertising, on the one hand, and, on the other hand, limits the visual field to what can be seen without moving the head from side to side, which is only a fraction of the e.g. hemisphere which faces the viewer. Moreover, aside from actually distorting the image, it is unnatural to read words or view pictures or likenesses that are drawn on a curved surface.

SUMMARY OF THE INVENTION

It is therefore an object according to the present invention to provide a balloon or inflatable with display surfaces for words or images that are substantially flat, so as to avoid distorting the words or images, and to allow for a natural viewing or reading of the same.

It is a further object according to the present invention to provide such additional display surfaces without modifying or changing the basic exterior curvature of balloons and inflatables.

This is accomplished according to the present invention by providing the balloons and inflatables with additional interior display surfaces by means of a sheet of flexible material which is adhesively connected to the inside of the balloon. Rather than being an interior "skin", or second wall, which hugs the wall of the balloon, the flexible sheet is connected at a plurality of points on its periphery to the inside wall of the balloon, so as to divide the interior volume of the balloon into two chambers. By using for the balloon a material which is at least partially translucent, or even transparent, one can view the flexible sheet that is positioned inside the balloon.

To employ the flexible sheet that is adhesively connected to the inside of the balloon as a display surface, one need only pre-print the sheet with a desired image or words, or attach small objects or letters onto the sheet. The sheet need not have a smooth, continuous surface such as the balloon or inflatable itself must display. Since the flexible sheet connected inside the balloon need not itself be air-tight, it can have practically any configuration, such as e.g. a sheet with holes, to simulate Swiss cheese, with a toy mouse attached, a gauze sheet, a woven pattern with loose or tight weave, as desired for a particular purpose, a large letter, e.g. a capital A, adhesively connected to the balloon inside wall at the top of the A and at both feet of the A, a sheet of porous floccose material, i.e. having a non-uniform arrangement of fibers, with fluffy tufts, such as e.g. a sheet of absorbent cotton.

The choice of flexible sheet for a given display purpose is limited only by the imagination of the designer or artist. The invention is to adhesively connect such a flexible sheet to the inside of a balloon, thereby providing additional display surfaces, and is not limited to a particular type or material of flexible sheet. The only requirements are that it can be adhesively connected at a plurality of points on its periphery to the inside wall of the balloon or inflatable, and that it be somewhat flexible to allow for inflating and deflating of the balloon without damaging itself or the balloon.

Although the invention is not limited to any particular way of connecting the flexible sheet to the inside wall of the balloon, the inventor has had best results by first turning the balloon inside out, then adhering the flexible sheet to the surface of the balloon, and finally turning the balloon right side out, thus leaving the flexible sheet on the inside as desired.

It is a particular embodiment according to the present invention to utilize a flexible, but relatively inelastic material, such as e.g. vinyl, or mylar, for the balloon and for the flexible sheet, when the balloon or inflatable is to be utilized as a beach ball.

It is a further particular embodiment according to the present invention, when the balloon or inflatable is to be used as a beach ball, to use a non-porous, vinyl or mylar sheet as the flexible sheet, and to adhere a circular such sheet all along its circumference to the inside wall of the beach ball.

It is another particular embodiment according to the present invention to utilize a flexible, elastic material, such as e.g. latex or rubber, or any rubbery, stretchable material, for the balloon and for the flexible sheet, when the balloon or inflatable is to be utilized, in particular, for display or novelty purposes, or as a child's toy. When this is done, the balloon is generally anchored by means of a string, a thin wooden or plastic stick, or to e.g. a flower pot, or adhered to a surface, such as a wall or ceiling or to a table top.

As mentioned above, the balloon material should be transparent or at least somewhat translucent, so that the flexible sheet adhered to the inside wall and which forms the additional display surfaces, can be easily viewed. With ordinary latex balloons, the stretching that occurs upon inflation is sufficient to result in a thinness of balloon wall, to the extent that the balloon is translucent, practically without regard to the color of the latex. Accordingly, when the balloon material is an ordinary latex balloon, the flexible sheet adhered to the inside wall can be easily viewed from the outside of the balloon.

In general, when a flexible, but relatively non-elastic balloon material and flexible sheet material are desired, any flexible, air-tight material will be acceptable, such as e.g. vinyl, mylar, polypropylene, polyethylene, polyethylene terephthalate, polyester, nylon, to name just a few.

When in particular a flexible but elastic, air-tight material is desired, any rubbery material is acceptable, such as e.g. latex, viscose, isoprene.

When a flexible but elastic sheet is desired for the additional display surfaces adhered to the inside wall of the balloon, any rubbery material is acceptable, such as e.g. latex, viscose, isoprene. However, rather than a solid (i.e. non-porous) sheet, a woven or irregularly arranged fibrous mat can be employed, in which case the fibers need not be very elastic per se, inasmuch the necessary stretching, to accomodate the inflation and stretching of the balloon, of the sheet itself, can be provided by fiber re-arrangement, rather than stretching of the fibers themselves. One need only imagine pulling apart a ball or sheet of absorbent cotton. The fibers themselves do not stretch, but the arrangement of the fibers loosens, thereby providing a stretching effect.

According to a particular embodiment of the invention, the flexible sheet is made out of a stretchable, porous, floccose material, i.e. a material having dense, fluffy tufts. The fibers of the floccose material can be made of any of the above-mentioned materials or any synthetic, nylon-like substance, such as e.g. vinyl, mylar, polypropylene, polyethylene, polyethylene terephthalate, polyester, nylon, viscose, dacron, cotton, cellulose, or the like.

An example for the floccose sheet material is the product available from e.g. Forum Novelty Distributors, Inc., Queens, N.Y. and from Party Originals, 7113 Thirteenth Avenue, Brooklyn, N.Y. 11228, labeled "Reusable stretchy © spider webs, made in U.S.A."

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
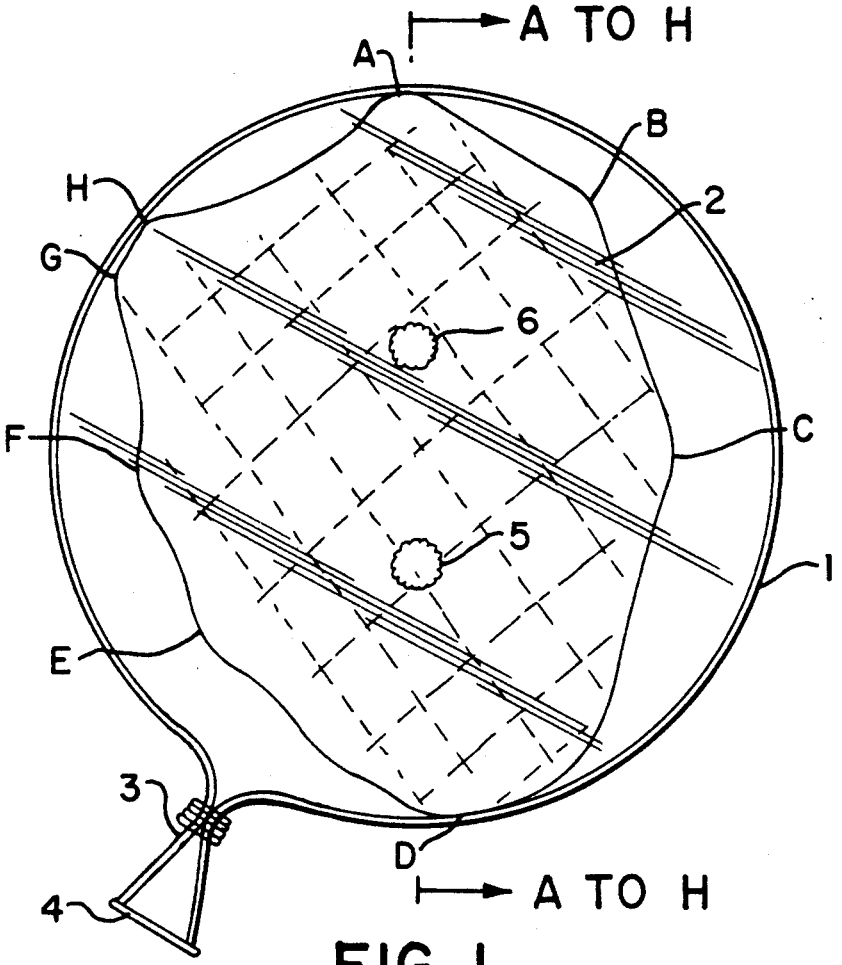
FIG. 1 is a front, perspective view of a balloon according to the present invention, with a flexible sheet adhered inside, visible from the outside.

In the embodiment shown in FIG. 1, reference numeral 1 is the flexible, inflatable, non-porous bag or balloon, in this case made of latex. Bag 1 is inflated through neck 3, which is then closed off to keep the gas (air or helium, preferably, although other gases can be used) from escaping, by means of closure means 4, in this case, a metal or plastic clip.

Numeral 2 is the flexible sheet which provides the additional display surfaces according to the present invention. In the present embodiment, the sheet 2 is made of a stretchable, porous, floccose Dacron polyester. (It could also be made of Lycra spandex fibers, or any of the other synthetic materials mentioned above.) Fluffy tufts 5, 6 of floccose material are shown on sheet 2.

Figure 2:
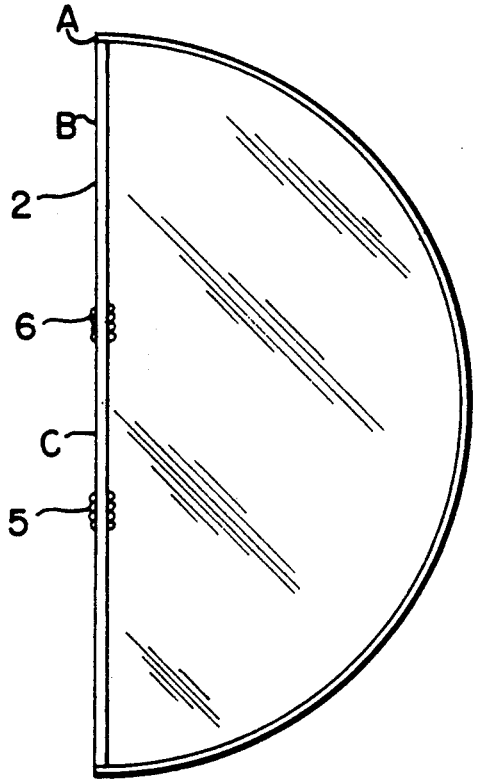
FIG. 2 is a side view, cut-away through points A, B, C and D, of the balloon according to FIG. 1.

FIG. 2 is a side cut-away view from FIG. 1, taken along plane A, B, C and D. Points A through H in FIG. 1, and A through D in FIG. 2, are points of contact between the flexible sheet 2 and the inside wall of balloon 1. Depending upon the material employed for the flexible sheet 2, a greater or lesser number of contact points for adhesion will be necessary. It is only required that there be a plurality of adhesion points between the sheet 2 and the inside wall of balloon 1. For example, if the sheet 2 is in the shape of a capital letter A, for e.g. advertising or message purposes, there would obviously be a minimum of three points of contact for adhesion purposes, to keep the letter A erect inside of the balloon 1. By means of the contact points between sheet 2 and balloon 1, the sheet is stretched sufficiently tightly so as to prevent its laying upon the inside wall of balloon 1 across the entire sheet surface, or a part of it. Instead, the sheet 2 is meant to hang suspended across the interior volume of the balloon 1, i.e. to divide the interior volume of the balloon into two chambers.

Sheet 2 is adhesively connected at a plurality of points on its perimeter or periphery, to the inside wall of balloon 1 by means of any common adhesive, e.g. mucilage, glue, cement, epoxy, rubber cement, polyacrylic adhesive such as so-called "crazy glue", among others.

When a floccose, porous, flexible sheet is used for the additional display surfaces according to the present invention, it gives the distinct impression of a spider's web. For this purpose, a balloon according to the invention with such a sheet inside it can advantageously be utilized in the novelty and party goods business as a Halloween decoration. Moreover, it can be employed in Fun Houses at amusement parks, for example. Small rubber or plastic insects and spiders can be attached to the spider web, for realism.

It will be understood that each of the elements described above, or two or more together, may also find a useful application in other types of displays differing from the types described above.

While the invention has been illustrated and described as embodied in a balloon with additional interior display surfaces, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letter Patent is set forth in the appended claims:

1. Balloon with additional interior display surfaces simulating a spider web, comprising a latex bag having an inside wall and an outside wall, and means for inflation with a gaseous medium, said bag when inflated defines an interior volume, and a sheet composed of an irregularly arranged fibrous mat of stretchable, porous, floccose material, said sheet having a perimeter, and said sheet is adhesively connected at a plurality of points on its perimeter to said inside wall of said bag, said sheet thereby constituting additional interior display surfaces of said balloon simulating a spider web, whereby said sheet divides said interior volume of said bag into two chambers when said bag is inflated.

2. In a novelty balloon, of the type composed of a rubbery, stretchable material, said balloon having an inside wall and an outside wall, and said balloon displays stretching upon inflation, the improvement comprising a sheet composed of an irregularly arranged fibrous mat of a stretchable material adhesively connected at a plurality of points to said inside wall of said balloon, whereby said sheets stretches to accomodate stretching of said balloon upon inflation.

3. The balloon according to claim 2, wherein said balloon is composed of a material selected from the group consisting of latex, viscose and isoprene.

4. The balloon according to claim 2, wherein said sheet is composed of material selected from the group consisting of nylon, rayon, orlon, dacron, lycra, cotton, cellulose, cellophane, vinyl, mylar, polypropylene and polyethylene.

5. The balloon according to claim 2, further comprising letters, words or images of plastic, vinyl, mylar, polypropylene, paper, cardboard or any suitable material are adhesively connected to said sheet.

6. The balloon according to claim 2, wherein said sheet is composed of a stretchable, rubbery material selected from the group consisting of latex, viscose and isoprene.

7. The improved novelty balloon according to claim 2, wherein said fibrous mat is composed of a porous, floccose material.

* * * * *